US006486839B1

(12) United States Patent
Minter

(10) Patent No.: US 6,486,839 B1
(45) Date of Patent: Nov. 26, 2002

(54) RELATIVE ELEVATION DETECTION FOR AIRCRAFT PILOT WARNING SYSTEM

(76) Inventor: Jerry B. Minter, 48 Normandy Heights Rd., Convent Station, NJ (US) 07961

( * ) Notice: Subject to any disclaimer, the term of this patent is extended or adjusted under 35 U.S.C. 154(b) by 0 days.

(21) Appl. No.: 09/693,075

(22) Filed: Oct. 20, 2000

(51) Int. Cl.[7] ..... H01Q 1/28

(52) U.S. Cl. ..... 343/705; 343/827; 343/831

(58) Field of Search ..... 343/843, 740, 343/903, 705, 708, 827, 829, 825, 826, 831, 893, 702; 327/2, 12, 20; H01Q 1/28

(56) References Cited

U.S. PATENT DOCUMENTS 4,000,466 A * 12/1976 Scouten et al. ..... 324/181
4,298,872 A * 11/1981 Rodgers ..... 343/100 LE
5,068,668 A * 11/1991 Tsuda et al. ..... 342/362
5,248,988 A * 9/1993 Makino ..... 343/792
5,506,590 A * 4/1996 Minter ..... 342/462
5,771,022 A * 6/1998 Vaughan et al. ..... 343/702
5,861,846 A * 1/1999 Minter ..... 342/443
5,905,767 A * 5/1999 Fujimura ..... 375/355
5,923,302 A * 7/1999 Waterman et al. ..... 343/846
5,995,064 A * 11/1999 Yanagisawa et al. ..... 343/895
6,147,653 A * 11/2000 Wallace et al. ..... 343/702
6,239,755 B1 * 5/2001 Klemens et al. ..... 343/702
6,271,728 B1 * 8/2001 Wallace et al. ..... 330/286

* cited by examiner

*Primary Examiner*—Don Wong
*Assistant Examiner*—Trinh Vo Dinh
(74) *Attorney, Agent, or Firm*—Darby & Darby

(57) ABSTRACT

An elevation angle detection device uses signals from first and second of oppositely pointing antennas to determine an elevation angle of an emitting source. The signal from the second antenna is inverted and phase-compared with the direct signal from the first antenna. The first and second antennas are physically displaced along their axes by about ⅜ electrical wavelengths to establish a sensitive angular region of about ±7 degrees. In one embodiment of the invention, the phase of the signal from the first antenna is phase delayed slightly before being applied to the phase detector. This displaces the sensitive angular region upward. The phase of the signal from the second antenna is phase delayed slightly before being applied to a second phase detector. The signal from the first antenna is applied to the second phase detector without being phase delayed. This displaces the sensitive angular region downward. The sensitive angular regions produced by the first and second phase detectors overlap centered on a plane normal to the axes of the first and second antennas. The simultaneous presence of an emitter in the overlap is used to detect a crisis collision possibility.

10 Claims, 10 Drawing Sheets

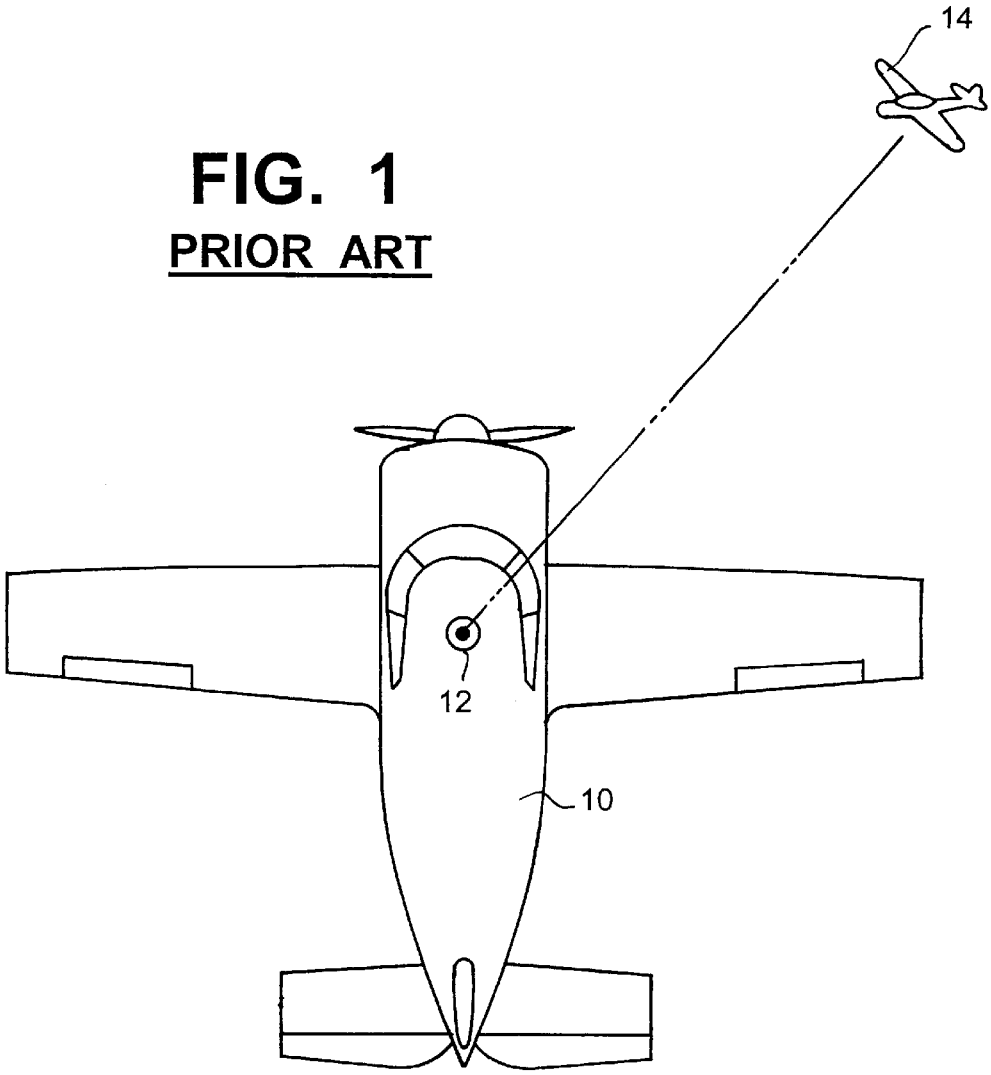
FIG. 1
PRIOR ART
FIG. 2
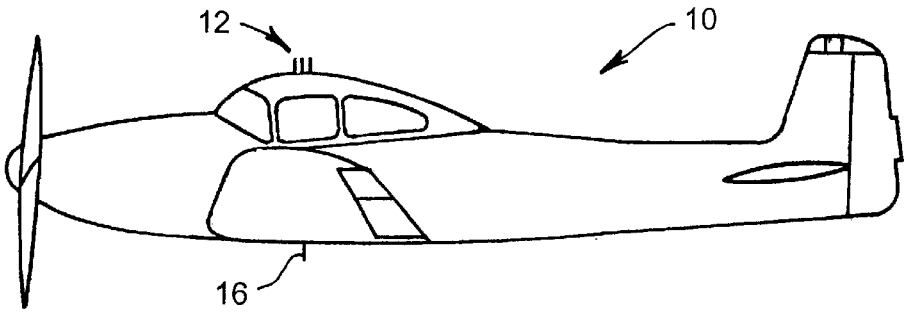

RELATIVE ELEVATION DETECTION FOR AIRCRAFT PILOT WARNING SYSTEM

BACKGROUND

The present invention relates to pilot warning systems and, more particularly, to a system for communicating an elevation of a target aircraft relative to the aircraft in which the system resides. Even more particularly, the present invention relates to a pilot warning system in which a bearing of nearby aircraft is enabled or inhibited depending on whether or not the nearby aircraft are traveling at an altitude which may result in collision with the aircraft carrying the system.

In my prior U.S. Pat. Nos. 5,506,590; 5,223,847 and 5,861,846, the disclosures of which are herein incorporated by reference, I disclosed systems for determining relative bearing and elevation of a nearby aircraft using passive reception of beacon transponder emissions or distance measuring equipment from the nearby aircraft. Relative bearing is determined by time relationships of transponder signals received on a plurality of antennae on a surface of the aircraft. Relative altitude is determined using vertically separated antennae, generally one on an upper surface, and one on a belly surface. The relative altitude is found in a comparison of the times of arrival of a signal at the upper and lower antennae.

In a single-signal environment, characteristic of areas with low air traffic, signals from the vertically separated antennae may be satisfactory for determining elevation by measuring differences in time of arrival of the signal at the upper and lower antennas. However, I have discovered that, in busy air traffic terminal control areas, time-of-arrival elevation determination is complicated by substantial overlapping of transponder signals from the many aircraft which are interrogated substantially simultaneously.

In addition to the time-of-arrival interference for vertical measurement, I have discovered that, in busy terminal control areas, bearing indications occur so frequently that it is difficult, even with the directional clues provided by my prior disclosures, to pinpoint a possibly dangerous collision risk.

OBJECTS AND SUMMARY OF THE INVENTION

It is an object of the invention to provide a system for the detection of the relative elevation of a target aircraft from a subject aircraft relative to the deck plane of the subject aircraft.

It is a further object of the invention to provide a system which can determine the relative elevation of a target aircraft from a subject aircraft relative to an inertial horizontal plane.

It is a still further object of the invention to provide a gating system for enabling display of a detected azimuth of a target that may be a collision risk only when a determination is made that the target is located relatively close to the altitude of the aircraft carrying the system, and inhibiting display of targets that are too high above, or too far below, to represent a danger.

Briefly stated, the present invention provides an elevation angle detection device which uses signals from first and second of oppositely pointing antennas to determine an elevation angle of an emitting source. The signal from the second antenna is inverted and phase-compared with the direct signal from the first antenna. The first and second antennas are physically displaced along their axes by about ⅜ electrical wavelengths to establish a sensitive angular region of about ±7 degrees. In one embodiment of the invention, the phase of the signal from the first antenna is phase delayed slightly before being applied to the phase detector. This displaces the sensitive angular region upward. The phase of the signal from the second antenna is phase delayed slightly before being applied to a second phase detector. The signal from the first antenna is applied to the second phase detector without being phase delayed. This displaces the sensitive angular region downward. The sensitive angular regions produced by the first and second phase detectors overlap centered on a plane normal to the axes of the first and second antennas. The simultaneous presence of a second emitting source in the overlap is used to detect a crisis collision possibility.

Briefly stated, the present invention provides an elevation angle detection device which uses signals from first and second oppositely pointing antennas to determine an elevation angle of an emitting source. The signal from the second antenna is inverted and phase-compared with the direct signal from the first antenna. The first and second antennas are physically displaced along their axes by about ⅜ electrical wavelengths to establish a sensitive angular region of about ±7 degrees. In one embodiment of the invention, the phase of the signal from the first antenna is phase delayed slightly before being applied to the phase detector. This displaces the sensitive angular region upward. The phase of the signal from the second antenna is phase delayed slightly before being applied to a second phase detector. The signal from the first antenna is applied to the second phase detector without being phase delayed. This displaces the sensitive angular region downward. The sensitive angular regions produced by the first and second phase detectors overlap centered on a plane normal to the axes of the first and second antennas. The simultaneous presence of an emitter in the overlap is used to detect a crisis collision possibility.

According to an embodiment of the invention, there is provided an antenna comprising: a first quarter-wave whip pointing in a first direction, a second quarter-wave whip pointing in a second direction opposite to the first direction, axes of the first and second quarter-wave whips being substantially collinear, a base of the first quarter-wave whip being spaced along the axis from a base of the second quarter-wave whip a distance effective to establish a desired relationship between phases of signals received on the first and second quarter-wave whips.

According to a feature of the invention, there is provided an elevation angle detection system comprising: a first antenna disposed in a first direction, a second antenna disposed in a second direction opposite the first direction, a phase inverter attached to the second antenna, the phase inverter producing a phase delay substantially equal to 180 electrical degrees at on operating frequency to produce a phase-delayed signal, a phase detector receiving a signal from the first antenna and the phase-delayed signal, and an output of the phase detector indicating the presence of an emitting source within a predetermined angle of a normal plane to the first and second directions.

According to a further feature of the invention, there is provided an alerting system comprising: a first antenna disposed in a first direction, a second antenna disposed in a second direction opposite the first direction, a phase inverter attached to the second antenna, the phase inverter producing a phase delay substantially equal to 180 electrical degrees at on operating frequency to produce a phase-delayed signal, a phase detector receiving a signal from the first antenna and the phase-delayed signal, an output of the phase detector indicating the presence of an emitting source within a predetermined angle of a normal plane to the first and second directions, a bearing angle detection device for detecting a bearing angle of the emitting source, and a suppression device effective for suppressing output of the bearing angle detection device when the emitting source is outside the predetermined angle, and for enabling the output of the bearing angle detection device when the emitting source is within the predetermined angle.

According to a further feature of the invention, there is provided an alerting system comprising: a first antenna disposed in a first direction, a second antenna disposed in a second direction opposite the first direction, a phase inverter attached to the second antenna, the phase inverter producing an inverted signal substantially inverted by about 180 electrical degrees at on operating frequency to produce a phase-inverted signal, a first phase detector receiving a signal from the first antenna, a first phase delay phase delaying the phase-inverted signal to produce a phase-delayed phase-inverted signal, the phase-delayed phase-inverted signal being applied to a second input of the first phase detector, a second phase detector receiving the phase-inverted signal at a first input, a second phase delay phase delaying the signal from the first antenna to produce a second phase-delayed signal, the second phase-delayed signal being applied to a second input of the second phase detector, a first AND gate responsive to a simultaneous output of the first and second phase detectors for producing a first output, a second AND gate responsive to a simultaneous output of the first phase detector and an absence of an output of the first AND gate for producing a second output, and a third AND gate responsive to a simultaneous output of the second phase detector and an absence of an output of the first AND gate for producing a third output.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1 is a plan view of an aircraft to which reference will be made in discussion my prior invention for pilot alerting based on azimuth determination.

FIG. 2 is a side view of an aircraft to which reference will be made in describing the present invention

DETAILED DESCRIPTION OF THE PREFERRED EMBODIMENT

Figure 3:
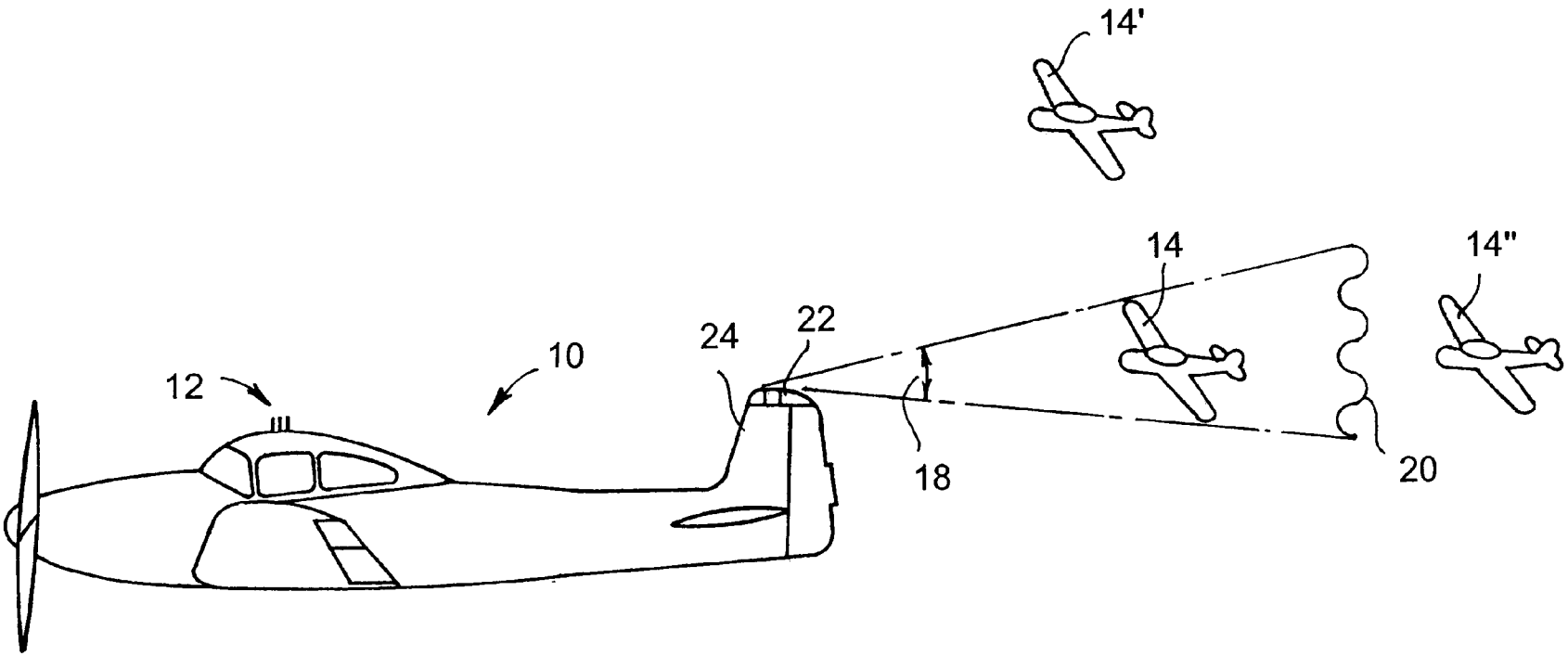
FIG. 3 is a side view of an aircraft showing elevation angle coverage limits.

Referring now to FIG. 1, an aircraft 10 includes a five-element antenna array 12 according to my prior patents and applications, the disclosures of which are herein incorporated by reference. As fully detailed in the referenced materials, antenna array 12 includes a central quarter-wave antenna the base of which is grounded momentarily to a ground plane midway during the reception of a 1090 MHZ ATCRBS (Air Traffic Control Radar Beacon System) or TCAS signal. The central antenna is surrounded by four additional quarter-wave antennas (not shown in detail in the figure), each connected to its own receiver channel. When the center antenna is ungrounded, each of the four surrounding antennas has essentially an omnidirectional pattern characteristic of a quarter-wave antenna. When the base of the central antenna is grounded, the pattern for each of the four surrounding antennas changes to the directional pattern characteristic of a two-element parasitic array. In such a parasitic array, the signal strength of a target along a line from the central antenna through the grounded one of the four surrounding antennas is enhanced, while the signal strength of a target in the opposite direction is reduced on the same antenna. A switching device in aircraft 10 periodically connects the base of the central quarter-wave antenna to the ground plane to form momentarily a two-element parasitic array for reception of a beacon transponder (ATCRBS) or TCAS signal emitted by a target aircraft 14. The azimuth direction to radio-emitting target aircraft 14 is determined by comparing the amplitudes of the signals received on the four different two-element parasitic antenna arrays.

As fully detailed in my prior patents and applications, advantage can be taken of the fact that a beacon transponder or TCAS signal includes a pair of 0.45 microsecond framing pulses spaced exactly 20.3 microseconds apart. Data pulses between the framing pulses are variable, depending on the mode and the transmitted data, but the framing pulses themselves are constant. In the invention in my prior patents, the data pulses are ignored, and only the two framing pulses are used. When a 1090 MHZ pulse of 0.45 microseconds duration is received, a gate is enabled 20.3 microseconds after the onset of this pulse. If a second pulse occurs during the gate, there is a high probability that this second pulse is the second framing pulse of a beacon or TCAS signal. This permits easy timing for the switching of the base of the central antenna at 20.55 microseconds after the onset of the first pulse (20.3 microseconds interpulse period plus about 0.35 microsecond, a little more than half the 0.45 microsecond pulse width to place the switch-over within the second pulse period).

Referring now to FIG. 2, in my prior U.S. patent application Ser. No. 85,023, I disclose a technique, used with the above azimuth-directional array, for determining the elevation, relative to the deck angle of aircraft 10, of a radio-emitting source. This technique adds a single antenna 16 vertically displaced downward from antenna array 12. In a typical general-aviation aircraft, the vertical displacement between the top of a cockpit and the bottom of the aircraft is sufficient to permit time-of-arrival discrimination with relatively simple circuits. A vertical angle detection device employs the difference in time of arrival of pulse signals at the antenna array 12 and at single antenna 16 to identify signals originating within an elevation angle range of interest. For purposes of description, the elevation angle range of interest is taken to be plus or minus seven degrees, which relates to plus or minus 1000 feet at two miles. That is, if an emitter is discerned within +/−seven degrees of the deck angle of aircraft 10, it triggers an alarm indication, otherwise, it's significance is downgraded. This alarm capability may be enhanced using strength-is-range type ranging, as well as azimuth angle detection, as described in the referenced documents, to enhance the alerting relevance. For example, an emitter located 180 degrees off the bow (due aft) may be of as much interest as one located in the forward quadrant, since many general aviation accidents occur when one aircraft overtakes another. The aircraft being overtaken generally has poor or no visibility to the rear without rolling or turning the aircraft, and is thus vulnerable to an overtaking midair collision. Suitable warning techniques may be employed depending on the information developed.

Referring now to FIG. 3, the aircraft/target-aircraft situation is shown in more detail. The pilot of aircraft 10, in normal flight, is concerned only with a target aircraft 14 which lies within an elevation angle boundary 18 of about ±7 degrees of the deck angle of aircraft 10. Thus, the pilot has no interest in target aircraft 14' which is outside elevation angle boundary 18, either above (as shown) or below. In addition, the pilot remains unconcerned with a target aircraft 14" which is located outside a range limit 20. An elevation antenna array 22 array is preferably mounted in a relatively clear position such as, for example, atop a tail 24 of aircraft 10.

Although elevation angle boundary 18 is illustrated as an angular region behind aircraft 10, for convenience of illustration and description, in fact elevation angle boundary 18 is a region having the angular cross-section shown, but extending completely around aircraft 10. This is an important consideration because side closure and head-on closure are sometimes more important that overtaking closure in being responsible for midair collisions.

As noted in the background description, the prior-art time-of-arrival determination is easily disturbed by interfering signals. In fact, if interfering signals are within a few MHZ of each other, they may interfere. In the present invention, I take advantage of the fact that there are about 400 cycles transmitted in each pulse. Thus, comparing RF cycles gives an improvement in signal resolution of at least a factor of 400. However, since the present invention compares not only cycles, but also phases of the signals received, the improvement in resolution is much greater than 400. For two signals to produce an output, not only must they be exactly the same frequency (almost never obtained in the real world), but also they must have close to the same phase relationship.

Figure 4:
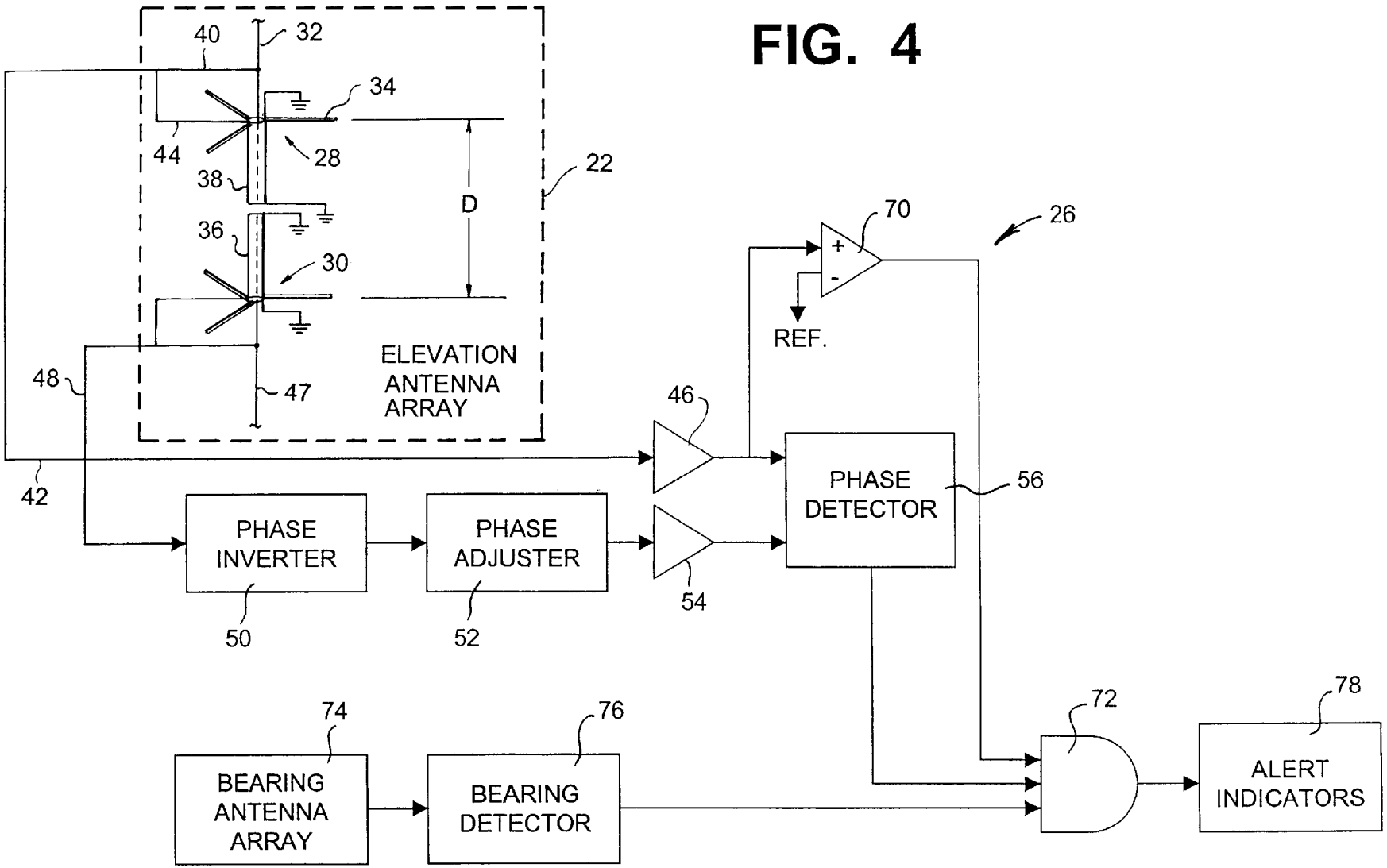
FIG. 4 is a schematic diagram of a elevation angle system according to an embodiment of the invention.
Figure 5:
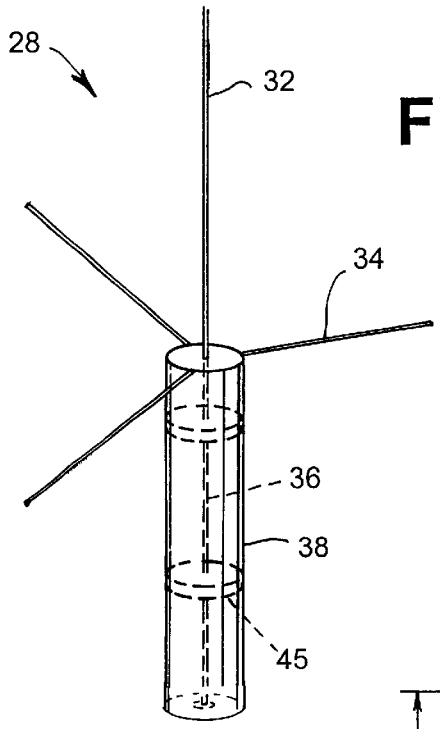
FIG. 5 is a perspective view of a microwave antenna usable in the present invention.

Referring now to FIGS. 4 and 5, an elevation angle system, shown generally at 26, includes an UP antenna 28 and a DOWN antenna 30. UP antenna 28 and DOWN antenna 30 each includes a quarter-wave whip 32, extending beyond a ground plane 34. In one embodiment, ground plane 34 is a trio of grounded stiff wires, spaced 120 angular degrees apart extending at right angles to quarter-wave whip 32. Instead of stiff wires, ground plane 34 may be a conductive disk, or any other suitable type of ground plane. A quarter-wave stub 36 extends in the opposite direction from quarter-wave whip 32 inside a coaxial shield 38. The inner end of quarter-wave stub 36 is grounded to coaxial shield 38. As is well known, a shorted quarter-wave coaxial line appears, at its input, to be an open circuit. However, for present purposes, the shorting of the inner end of quarter-wave stub 36 is useful in an aviation environment for protection against lightning. A center conductor 40 of a coaxial transmission line 42 is connected to the junction of quarter-wave whip 32 and quarter-wave stub 36. A grounded shield 44 of coaxial transmission line 42 is connected to coaxial shield 38 adjacent the connection of center conductor 40 to quarter-wave whip 32. A signal on UP antenna 28 is connected on coaxial transmission line 42 to an input of a microwave amplifier. In the embodiment shown in FIG. 5, quarter-wave stub 36 is a center conductor of an air-dielectric rigid coaxial line supported and centered in coaxial shield by a plurality of insulating disks 45. Since quarter-wave whip 32 and quarter-wave stub 36 are both in air, their lengths are approximately the same; that is, approximately one quarter wave length each at the operating frequency. Thus the end-to-end length of up antenna 28 (and DOWN antenna 30) is approximately one-half wavelength.

Except for the fact that its quarter-wave whip 47 points downward instead of upward (opposite to the direction of quarter-wave whip 32 of UP antenna 28), DOWN antenna 30 is identical to UP antenna 28. Quarter-wave whips 32 and 47 are substantially parallel to each other and are their axes are preferably substantially collinear. A signal on DOWN antenna 30 is connected on a coaxial transmission line 48 to an input of a phase inverter 50. As represented schematically, coaxial transmission lines 42 and 48 extend away from their respective antennas parallel to each other, and normal to the axes of the quarter-wave whips 32 and 47 for several wavelengths to avoid loop currents.

Instead of quarter-wave whips 32 and 47, loop antennas such as those shown and described in my U.S. Pat. No. 5,889,491 patent, may be used. However, test of the system using such loop antennas were troubled by their directionality. Although the directionality problem can be compensated using crossed pairs of loop antennas, this increases the complexity of the system. Thus, for the present invention, quarter-wave whip antennas 32 and 47 are preferred.

The signals on coaxial transmission lines 42 and 48 are identical, since they both derive from the same signals, except that, because their quarter-wave whips 32 and 47 point in opposite directions, the phases of the signals on them are approximately relatively inverted. Phase inverter 50 inverts the phase of the signal it receives on coaxial transmission line 48. A phase adjuster 52 is optionally included to permit vernier phase adjustments during initial setup of the equipment. The output of phase adjuster 52 is applied to the input of a microwave amplifier 54. The outputs of microwave amplifiers 46 and 54 are applied to signal inputs of a phase detector 56.

It is to be noted that microwave amplifiers 46 and 54 do not produce heterodyne mixing, or other processing of the signals that they receive, except for a small amount of frequency selectivity. Thus, if the two signals originate from a source that is equally far from the two antennas, that is, on a normal plane bisecting the vertical center of elevation antenna array 22, then the two signals add together in phase detector 56 to produce a maximum output. As the signal source is displaced upward or downward from the normal plane, the output of phase detector 56 decreases.

The output of microwave amplifier 46 is also applied to one input of a threshold detector 70. The other input of threshold detector 70 receives a reference voltage Vref which determines the amplitude of output from microwave amplifier 46 above which a logic 1 is produced. At inputs below Vref, threshold detector 70 produces a logic 0 output. The output of threshold detector 70 is applied to one input of an AND gate 72. The output of phase detector 56 is applied to a second input of AND gate 72.

A bearing antenna array 74, such as disclosed in my prior patents, feeds signals to a bearing detector 76, also according to my prior patents. The output of bearing detector 76 is applied to the third input of AND gate 72. The bearing of target aircraft 14, as determined by bearing detector 76, is displayed on a set of alert indicators 78 only when the output of threshold detector 79 and the output of phase detector 56 have sufficient amplitude to enable their respective inputs of AND gate 72. That is, range limit threshold 20 (FIG., 3) is enforced by threshold detector 79, which requires an input signal exceeding reference voltage Vref, and elevation angle boundary 18 (FIG. 3) is enforced by the output of phase detector 56 which produces an enable signal only in response to elevations of target aircraft 14 of ±7 degrees. Thus, the alerting system of the present invention produces an alert signal only when target aircraft 14 is inside range limit threshold 20 and within elevation angle boundary 18. It remains quiescent for all aircraft outside these two limits, therefore eliminating false positive alerts which would distract a pilot from proper operation of aircraft 10.

In some applications, it may be desirable to use only the elevation angle to trigger an alert, without using the range data. In other applications, it may be desirable to use the combination of elevation angle and signal strength (range related) to trigger an alarm without using a bearing measurement. Such systems should be considered to fall within the scope of the invention.

I have discovered that the distance D between the bases of quarter-wave whip antennas 32 and 47 is critical in setting the angular coverage of elevation angle system 26. As the distance D increases, the angle of elevation angle boundary 18 (FIG. 3) also increases. Beyond a certain value of distance D, fringing and false positives interfere with accurate detection. As the distance D decreases, the angle of elevation angle boundary 18 decreases. I have found that an electrical length of distance D of about ⅜ λ gives the desired value of elevation angle boundary 18 of about ±7 degrees, without significant false positives. That is, the output of phase detector 56 increases from near zero at an elevation angle of about −7 degrees, passes through a maximum at an elevation angle of zero (target at same elevation) and then decreases to about zero at an elevation angle of +7 degrees.

Figure 6:
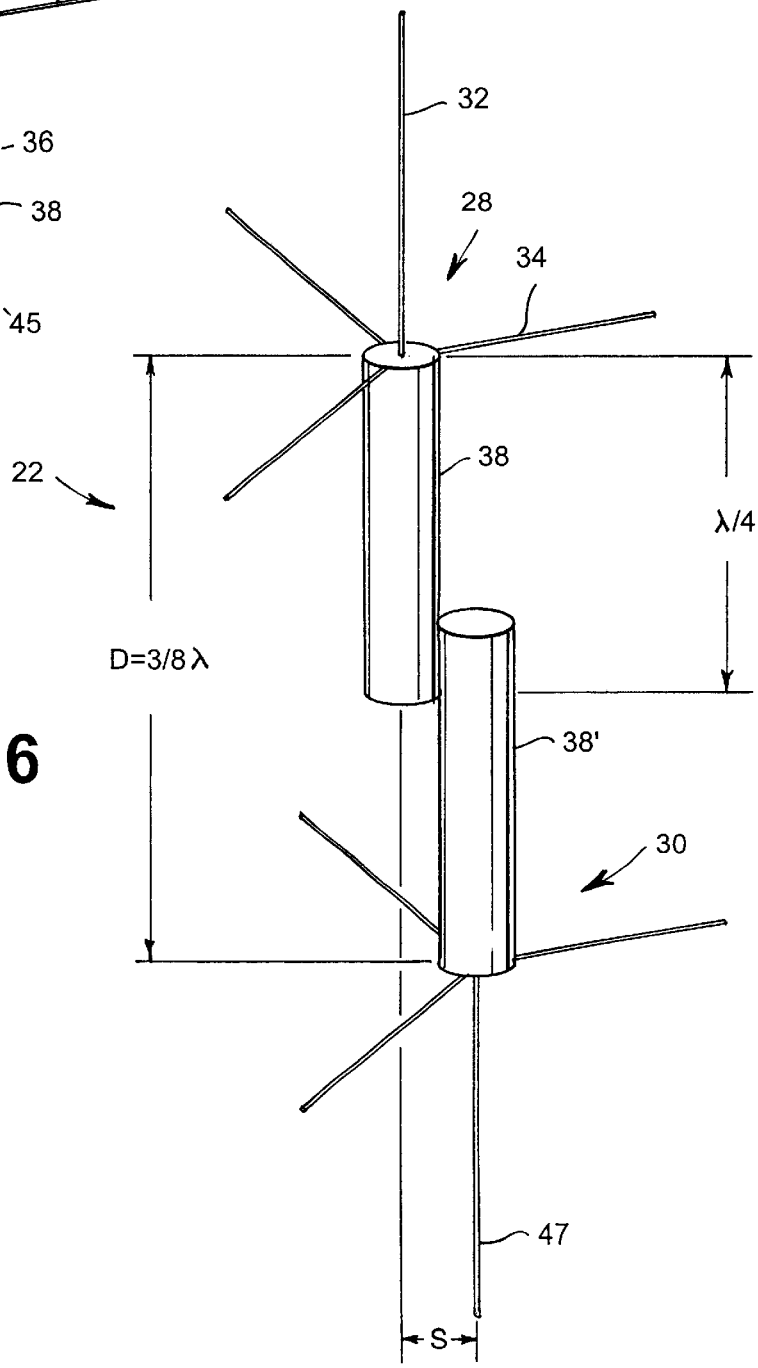
FIG. 6 is a perspective view of an elevation antenna array using the microwave antenna of FIG. 5.

Referring now to FIG. 6, since the physical and electrical lengths of an air-dielectric coaxial line are approximately equal, the physical and electrical lengths of quarter-wave stubs 36 and 36' are both about ¼ at the operating frequency. Thus the combined lengths of the two quarter-wave stubs 36 is about ½ λ. As a consequence, to attain an electrical and physical length of distance D=⅜ λ, the ends of the coaxial shields 38 and 38' of the two quarter-wave stubs 36 and 36' must be overlapped. Overlapping the ends of coaxial shields 38 and 38' causes an accuracy problem since this displaces the axes of quarter-wave whips 32 and 47 transversely apart a distance S. Distance S is approximately equal to the diameter of one of coaxial shields 38 or 38'. Accordingly, the signal from a target aircraft at exactly the same altitude (zero elevation angle) only has the same phase from quarter-wave whips 32 and 47 when the target is on a bisector of a line between quarter-ave whips 32 and 47. When the target is on a line passing through the axes of quarter-wave whips 32 and 47, the phases of the signals from quarter-wave whips 32 and 47 is different an amount related by the diameter of one of coaxial shields 38 or 38'. Since the diameter of shields of common air-dielectric is from about ¼ to about ½ inch, then the antenna-to-target distances vary by this amount depending on the rotational angle of the target from elevation antenna array 22. This anomaly can be at least partially corrected by inclining quarter-wave whips 32 and 47 slightly so that a midpoint of each passes through a common axis, generally along a projection of a line of contact between coaxial shields 38 and 38'.

Figure 7:
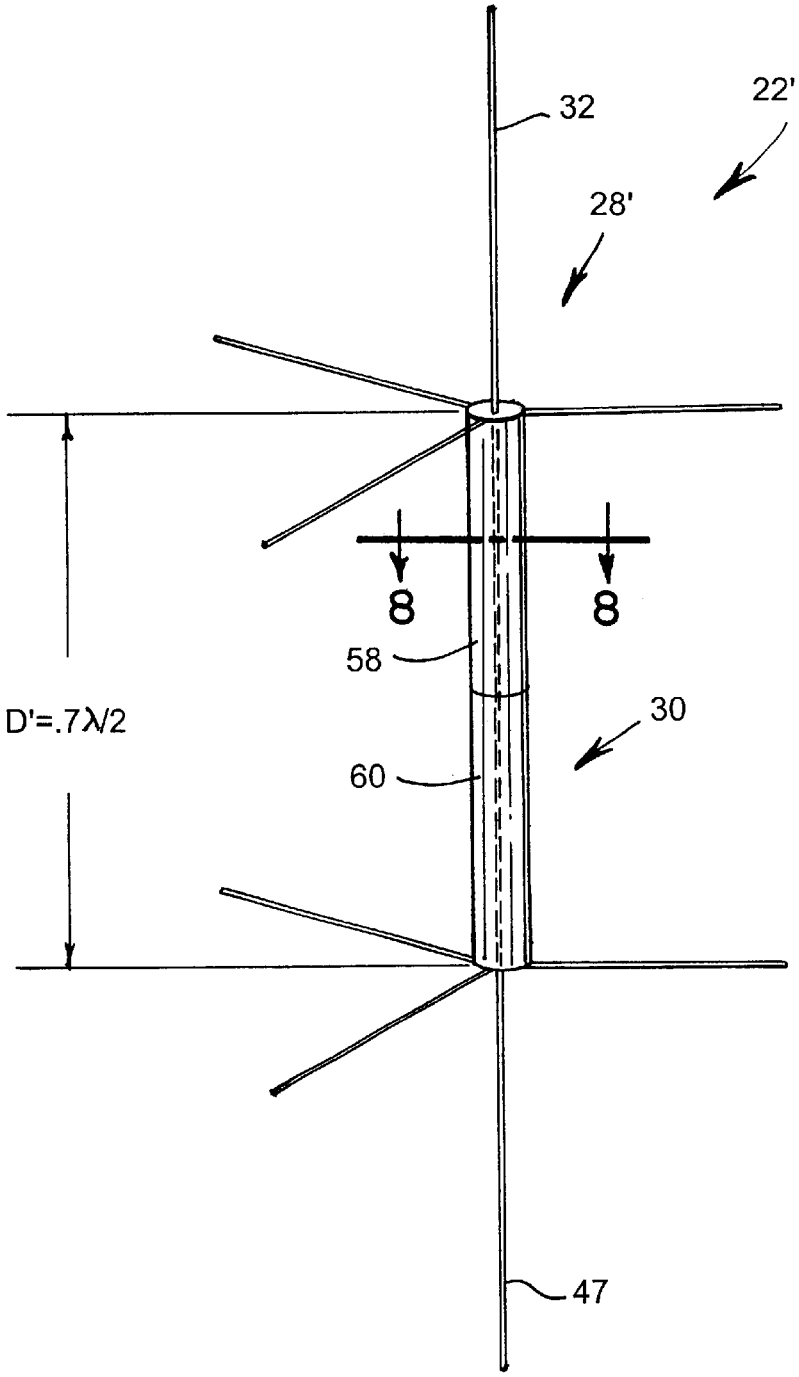
FIG. 7 is a perspective view of an elevation antenna array in which overlap is avoided by the selection of a dielectric having a velocity factor suitable for physically shortening the distance between bases of the UP and DOWN antennas.
Figure 8:
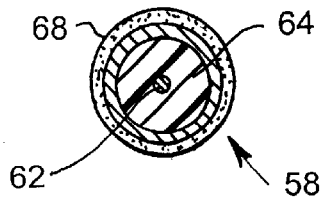
FIG. 8 is a cross section taken along line 8—8 of FIG. 7.

Referring now to FIG. 7, an embodiment of an elevation antenna array 22' avoids the offset problem of the air-insulated coaxial antenna of FIG. 5. Referring momentarily to FIG. 8, quarter-wave stub 58 (the same as quarter-wave stub 60, not shown), includes a center conductor 62 surrounded by a resin dielectric 64. Resin dielectric 64 is surrounded by a metallic shield braid 66. A fabric cover 68 optionally covers the outer surface of shield braid 66. By selecting a resin dielectric 64 of Teflon, I was able to solve the offset problem between the axes of quarter-wave whips 32 and 47 of the embodiment of the invention in FIG. 6.

Returning now to FIG. 7, it will be noted that quarter-wave stubs 58 and 60 are collinear. This is made possible because the electrical length of a resin-insulated coaxial line is reduced from its equivalent physical length by a factor related to the propagation speed of an electrical signal in the insulation. A coaxial line having Teflon dielectric has a velocity factor of 0.7. Thus, the physical length of quarter-wave stub is reduced by 0.7 relative to its free-space electrical length of λ/4. Thus, when quarter-wave stubs 58 and 60 are placed end-to-end, as shown in FIG. 7, their combined electrical length is λ/2, but their combined physical length D' is about 0.35 λ=(0.5×0.7) λ. This is a close approximation of the desired physical length D of ⅜λ=0.357 λ. Since quarter-wave stubs 58 and 60 are collinear, then the axes of quarter-wave whips 32 and 47 are also collinear. The outer ends of shield braid 66 and center conductor 62 are connected together, and are grounded.

Any convenient type of coaxial cable may be used for quarter-wave stubs 58 and 60, 1 have found that suitable performance is achieved using a silver-plated coaxial cable W142B, made by Weico, and identified as Military Specification Grade. This coaxial cable has a diameter of about ⅛ inch. The total weight of the antenna built and tested is less one pound. This may be most important in helicopter use since a desirable mounting location is on a stabilized camera mount. Use of a stabilized mount, in helicopter service, eliminates possible errors due to the constant tilting of the deck angle in this type of vehicle.

Figure 9:
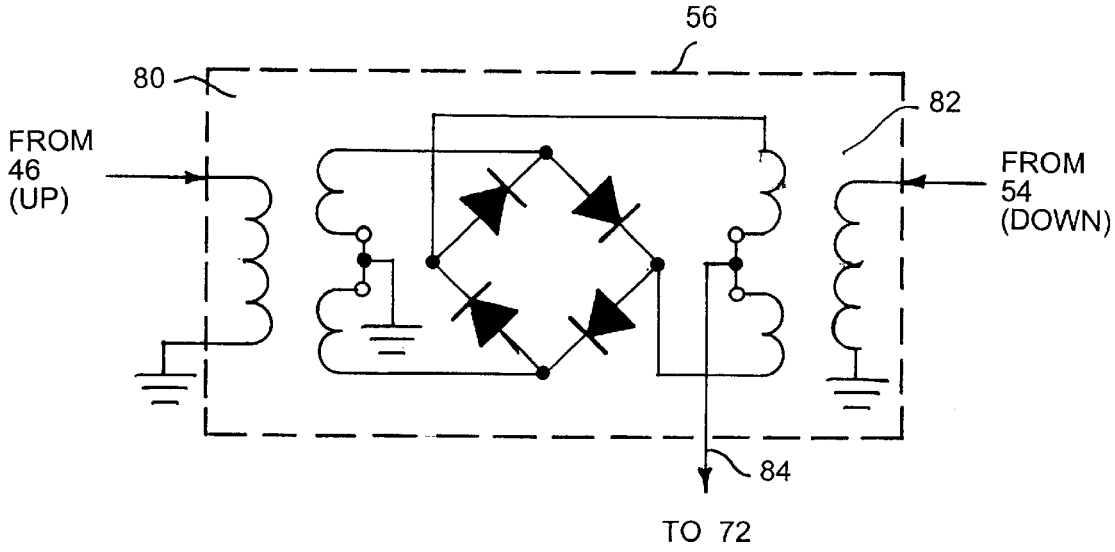
FIG. 9 is a schematic diagram of a phase detector used in the present invention.

Referring now to FIG. 9, a schematic diagram of phase detector 56 includes an UP input transformer 80, receiving the signal from UP antenna 28, and a DOWN input transformer 82 receiving the same signal (whose phase is related by the geometry) from DOWN antenna 30. An output 84 from the secondary winding of DOWN input transformer 82 is connected to an input of AND gate 72 (FIG. 4). It will be noted that phase detector 56 is, in essence, a double balanced modulator. Conventionally, balanced modulators receive one signal on a first input, and a second signal, generally a local oscillator signal, at a different frequency on a second input. The conventional output of a balanced modulator includes the two input frequencies plus sum and difference frequencies. Tuned circuits are then used to filter out the two input frequencies and one of the sum and difference frequencies to leave the other of the sum and difference frequencies as an intermediate frequency for further amplification and use.

Figure 10:
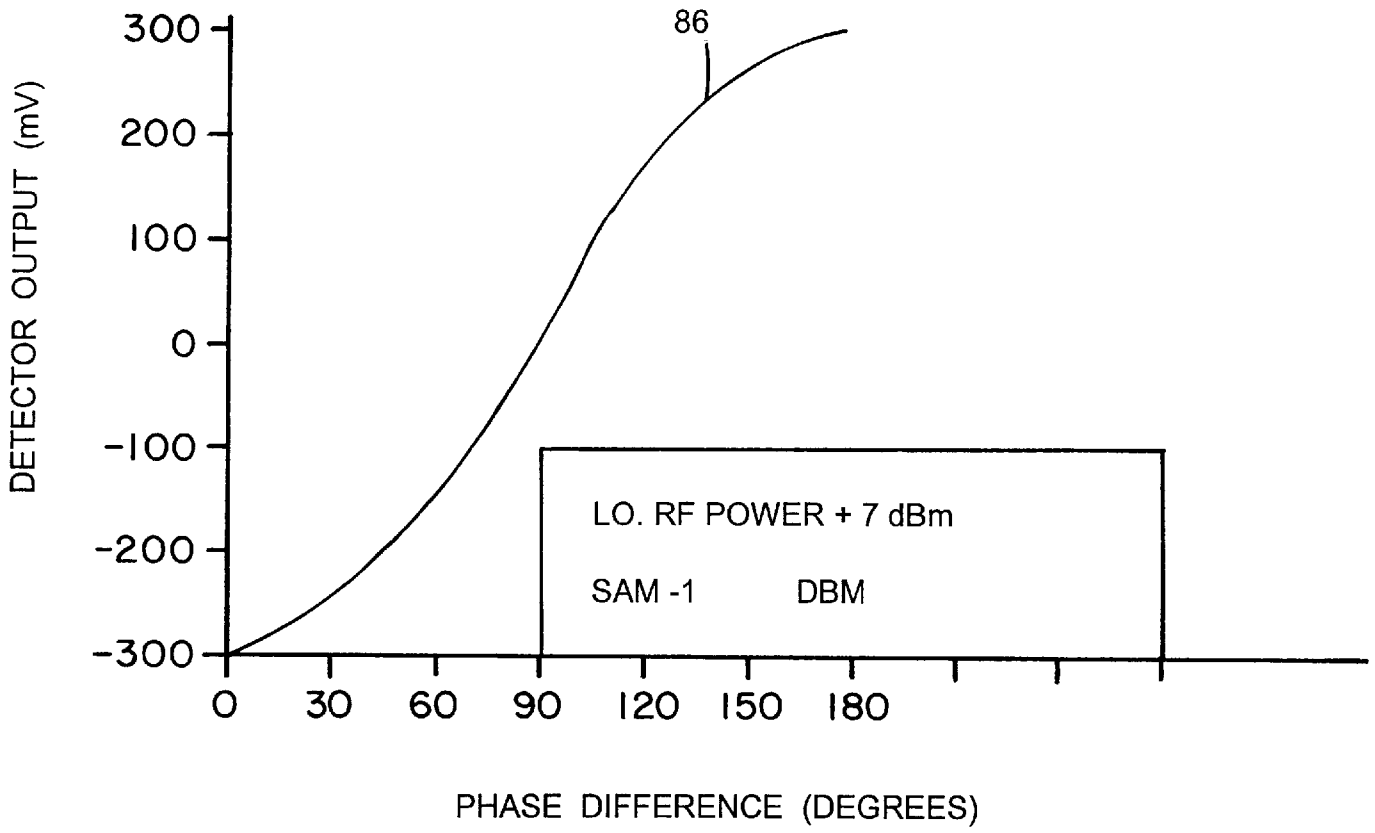
FIG. 10 is a plot of output vs relative input phases for the phase detector of FIG. 9.

Applications of phase detectors are known in which two signals, varying only in phase, are applied to the two inputs of phase detector 56. Referring now to FIG. 10, an output curve 86 of phase detector 56 shows a minimum, near zero volts, when the phase difference of its inputs is zero, rising to a maximum when the phase difference between its inputs is 180 degrees. Referring momentarily to FIG. 4, because of the phase inversion applied by phase inverter 50, for a target equidistant from UP antenna 28 and DOWN antenna 30, the two input signals are phase displaced 180 degrees from each other. As the target moves upward, the phase difference changes from a maximum at 180 degrees phase difference to zero when target aircraft 14 is about 7 degrees above the deck plane of aircraft 10. Similarly, as the target moves downward, the phase difference changes from 180 degrees to 360 degrees when target aircraft 14 is about 7 degrees below the deck plane of aircraft 10. The close spacing of UP antenna 28 and DOWN antenna 30, at approximately ⅜ λ, not only establishes the angular coverage of elevation angle boundary 18 at about ±7 degrees, but also ensures that, beyond this angular coverage, the output of phase detector 56 remains at or near zero without false positive indications.

The output of phase detector 56 is basically a unidirectional DC voltage whose amplitude is related to the closeness of coincidence of the phases of the signals on it two inputs. A simple filter (not shown) may be added to remove the fundamental frequency, as well as other possible interfering signals. Amplification of both input channels prior to phase detector 56 is performed without the need for heterodyning or other processing.

Figure 9A:
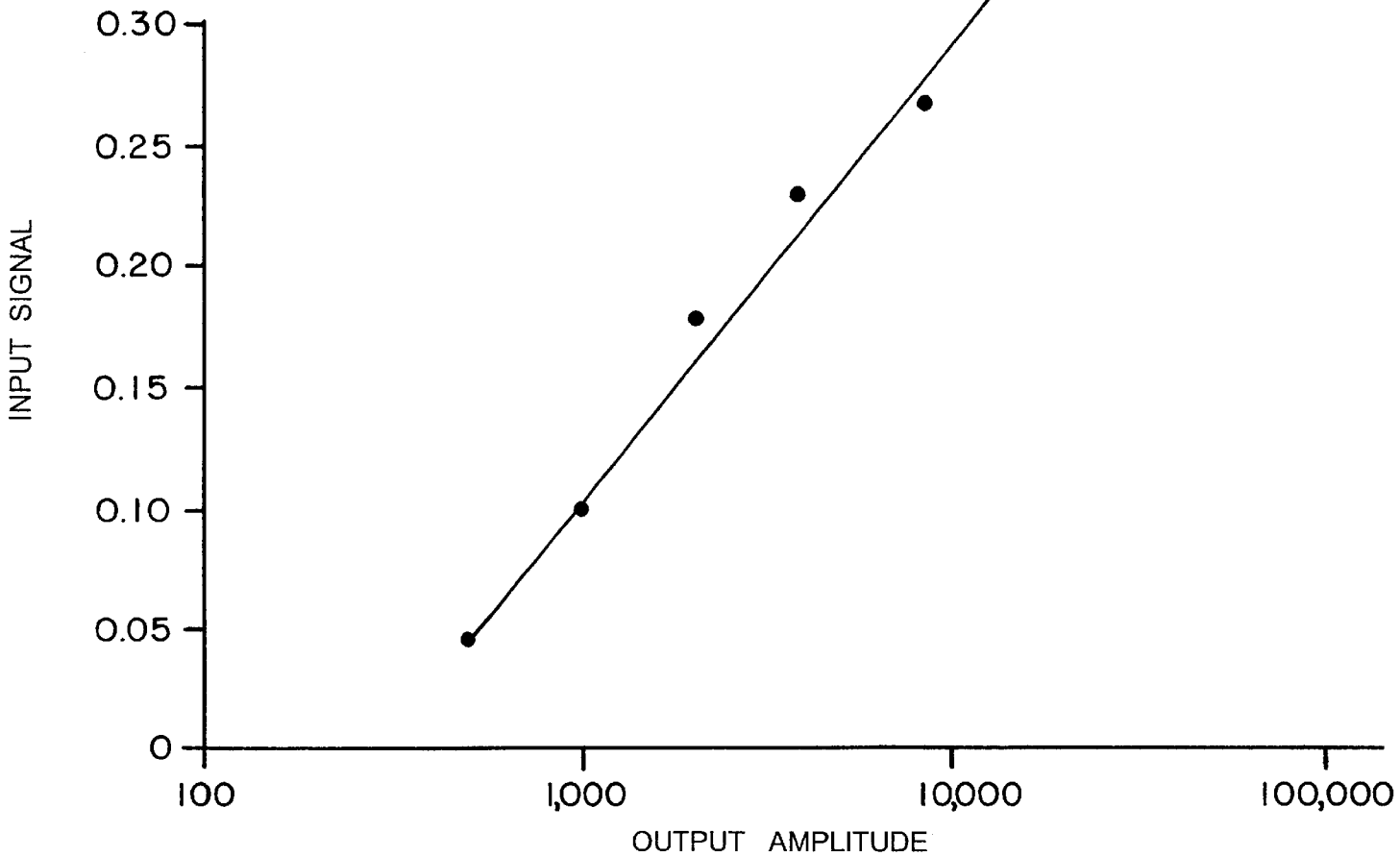
FIG. 9*a* is a plot of input vs output signal amplitude for the phase detector of FIG. 9.

Referring to FIG. 9*a*, an unexpected benefit of a commercial phase detector 56 from Mini-Circuits Corp. in Brooklyn, N.Y. which I used in a prototype of the system, is that the response is non-linear. That is, as the input signal strength increases, the output amplitude, although it also increases, does so non-linearly. My measurement indicate that, for an input signal increase of a factor of 32, from 500 μV to 16,000 μV, the output increases only by a factor of 7.5, from 0.043 volts to 0.300 volts. The input/output relationship plots as a good approximation of a straight line on a log-linear plot. This inherent automatic gain control simplifies downstream processing.

Referring again to FIG. 4, in one embodiment of the invention, phase adjuster 52 includes a plurality of phase adjust settings selected to move the point of maximum output upward and downward with respect to the deck plane of aircraft 10. The phase adjust settings are accomplished in any convenient way using, for example, a plurality of adjustment lengths of coaxial cable which bias the maximum upward and downward with respect to the deck plane. The different lengths are switched in manually or automatically to determine whether target aircraft is above, below, or same altitude. Then, if the detected signal has greater amplitude when the adjustment favors the UP direction, alert indicators 78 may indicate that target aircraft 14 is in the upward direction. If the detected signal has greater amplitude when the adjustment favors the DOWN direction, alert indicators 78 may indicate that target aircraft 14 is in the downward direction. If the signal is greatest when phase adjuster 52 produces a zero phase bias, then alert indicators indicate the most dangerous condition of target aircraft 14 located at the same altitude as aircraft 10. The present invention is indifferent to the particular type of indicator used. For example, an acoustic signal, an optical signal, or a combination of such signals may be used, according to my prior patents, or according to other alerting systems. For example, a synthesized voice may alert the pilot by producing a synthesized voice alert saying, for example "TARGET AT 9 O' CLOCK HIGH, DESCEND.".

In a further embodiment of the invention, phase adjuster 52 is a dynamic phase adjuster using, for example a ferrite rotator. As is known, a ferrite rotator retards the phase of a signal in proportion to a magnetic field applied thereto. The magnetic field is conveniently produced by a current applied to a coil interacting with the ferrite. Thus, the amount of phase delay is controlled by the current on the coil. In the present instance, a sweep circuit sweeps the current, and the phase in a sinusoidal fashion between values above and below the nominal 180 degrees imposed by phase inverter 50. Alert indicators 78 monitor the amplitude of the output of phase detector 56. Alert indicators 78 determines the phase adjustment which produces maximum output and uses the result to determine the target elevation angle. Then, alert indicators 78 use the detected target elevation to alert the pilot to the elevation of target aircraft 14.

The ferrite rotator referred to in the preceding paragraph may also be made responsive to compensate for roll and pitch angles of aircraft 10 so that elevation angle boundary can be an inertial space unperturbed by rolling and/or pitching of aircraft 10. Signals for producing compensating voltages for the ferrite rotator can be taken of the artificial horizon, or other inertial sensor in aircraft 10. Since one skilled in the art would be fully knowledgeable about phase control using ferrite rotators, and about techniques for derivation of control voltages from conventional cockpit instrumentation, further discussion thereof is omitted here from.

Figure 11:
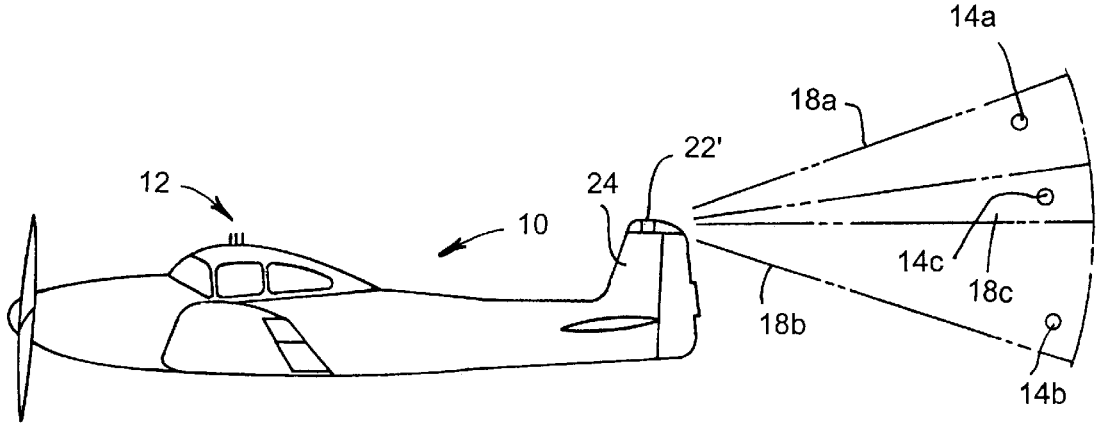
FIG. 11 is a side view of an aircraft illustrating the use of two overlapping elevation angle boundaries to give warning emphasis to target aircraft at or near the same altitude as the carrying aircraft.

Referring now to FIG. 11, an elevation angle array 22' is shown in which differential delays in two detection chains determine whether a target aircraft is above, below, or at the same elevation as aircraft 10. By imposing a slight phase delay, in addition to the phase inversion delay, on the signal from UP antenna 28, an upper angle boundary 18*a* is produced, offset upward about 5 degrees from deck level. Similarly, by imposing a slight phase delay, in addition to the phase inversion delay, on the signal from DOWN antenna 30, a lower angle boundary 18*b* is produced, offset downward about first 5 degrees from deck level. Since upper angle boundary 18*a* and lower angle boundary 18*b* are both about ±7 degrees, upper angle boundary 18*a* extends from about −2 degrees to about +12 degrees. Similarly lower angle boundary 18*b* extends from about +2 degrees to about −12 degrees. This produces a 4-degree overlap region 18*c* centered on the deck level of aircraft 10.

For later reference, it is assumed that an upper target aircraft 14*a* may be located within upper angle boundary 18*a*. In this position, upper target aircraft is detectable in upper angle boundary 18*a*, but is undetectable within lower angle boundary 18*b*. Similarly, a lower target aircraft 14*b*, may be detectable in lower angle boundary 18*b*, but is undetectable in upper angle boundary 18*a*. A same-altitude target aircraft 18*c* is detectable in overlap region 18*c* which consists of the lower part of upper angle boundary 18*a* and the upper part of lower angle boundary 18*c*.

Figure 12:
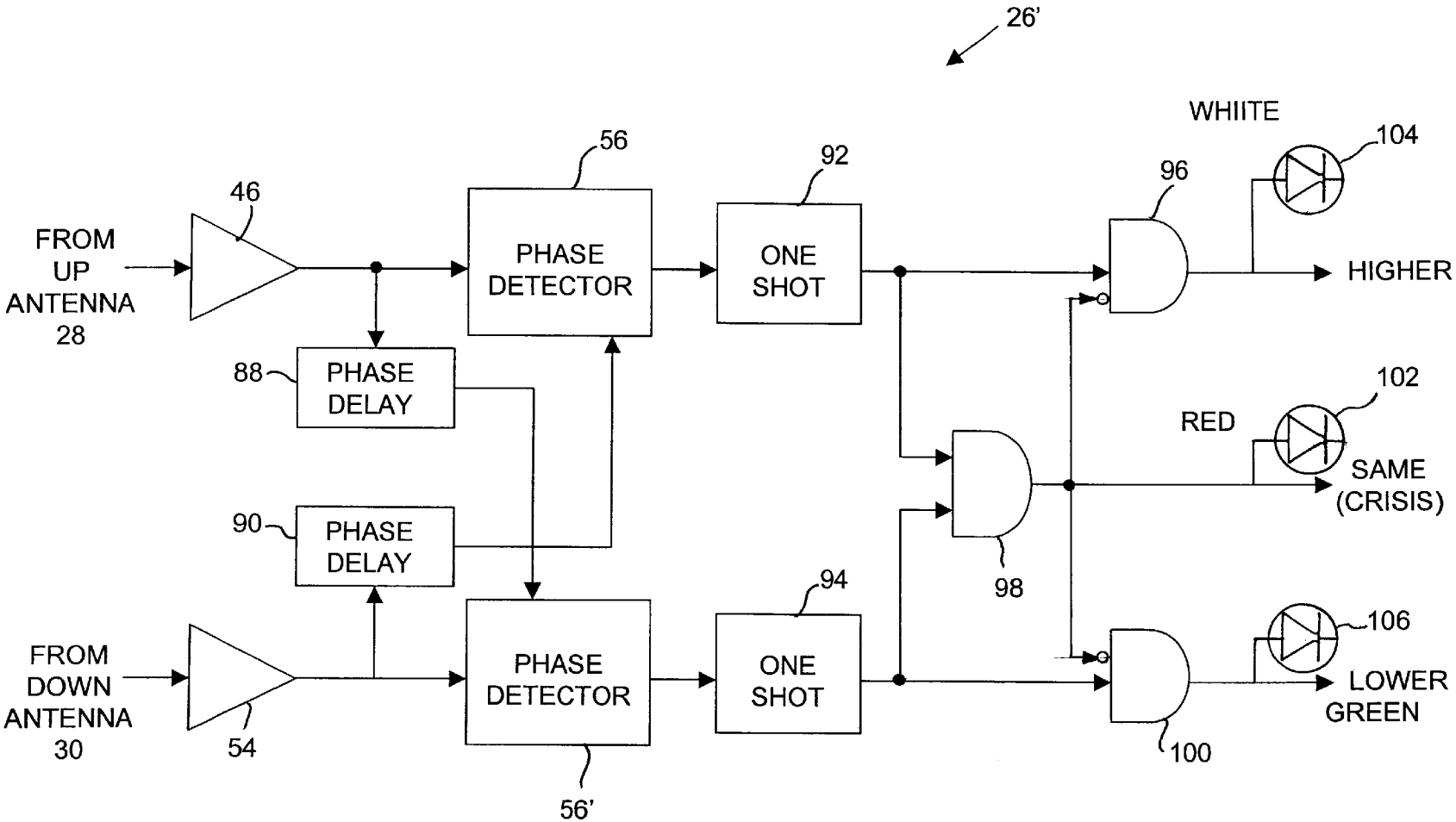
FIG. 12 is a schematic diagram of the system introduced in FIG. 11.
Figure 13:
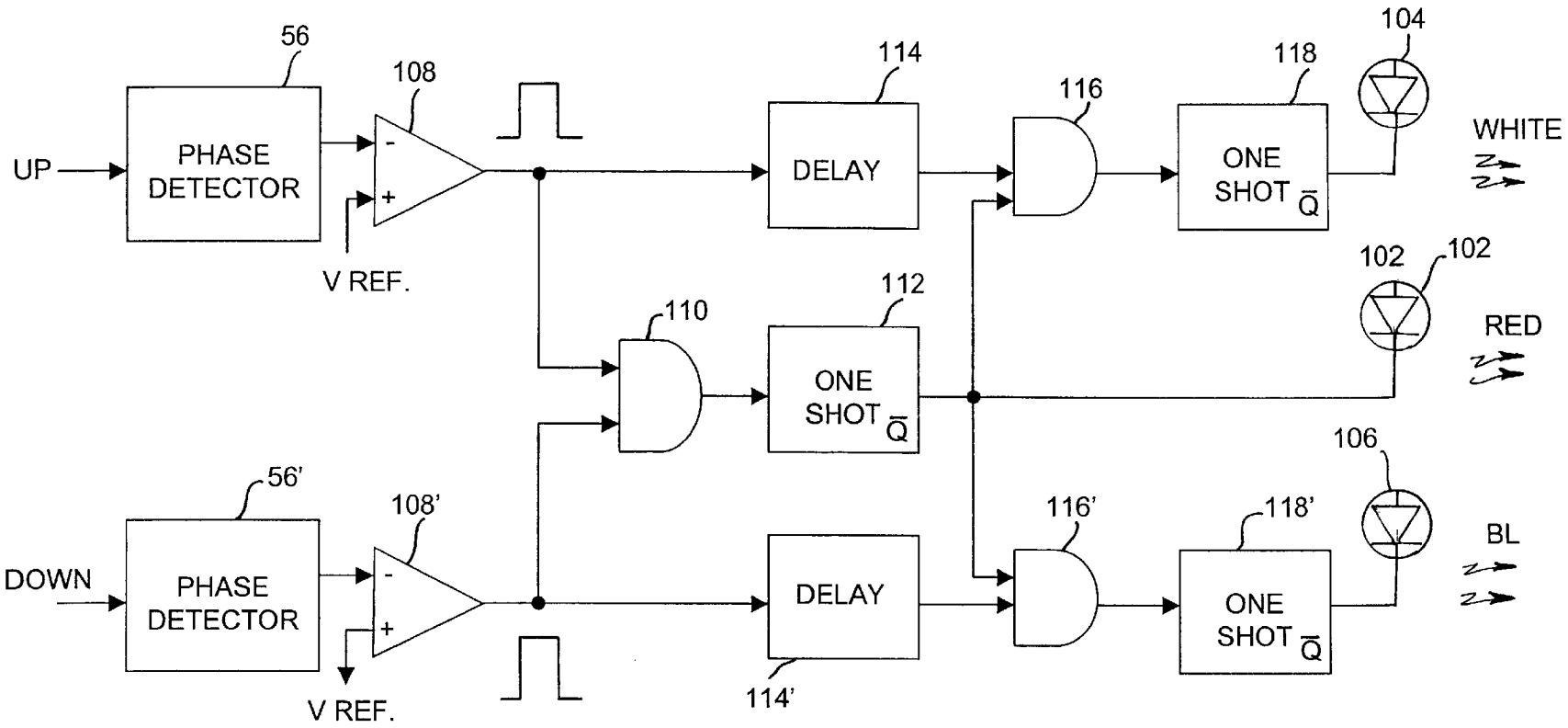
FIG. 13 is a schematic diagram of a further embodiment of an alerting system according to the invention.

Referring now to FIG. 12, an elevation angle system 26' is similar to elevation angle system 26 of FIG. 4, except for elements required to separate UP, DOWN, and SAME ELEVATION targets. The signal from UP antenna 28, after amplification in microwave amplifier 46, is applied to an input of phase detector 56. The phase of the signal from UP antenna 28 is delayed slightly in a phase delay 88. The phase-delayed signal is applied to an input of a second phase detector 56'. The signal from DOWN antenna 30, which has previously been delayed 180 degrees, and amplified in microwave amplifier 54, is applied to the second input of phase detector 56'. The signal from microwave amplifier 54 is delayed slightly in a phase delay 90. The phase-delayed signal from phase delay 90 is applied to a second input of phase detector 56. The outputs of phase detectors 56 and 56' are applied to trigger inputs of one-shots 92 and 94, respectively. The short pulse outputs of one-shot 92 are applied to enable inputs of AND gates 96 and 98. The short pulse outputs of one-shot 94 are applied to enable inputs of AND gates 98 and 100. The output of AND gate 98, indicating detection of target aircraft 14*c* in overlap region 18*c*, is transmitted to the alert indicators, as previously described, to warn of the crisis situation in which target aircraft 14*c* may be in a collision situation. The output of AND gate 98 is also applied to inhibit inputs of AND gates 96 and 100. That is, when AND gate 98 produces an output, outputs from AND gates 96 and 100, indicating a target aircraft above or below aircraft 10, are inhibited. In the absence of a target aircraft in overlap region 18*c*, an output from AND gate 96 indicates the presence of target aircraft 14*a* above aircraft 10, and an output from AND gate 100 indicates the presence of target aircraft 14*c* below aircraft 10.

In one embodiment of the invention, the outputs of AND gates 96, 98 and 100 energize one or more individual optical indicators such as, for example, light-emitting diodes (LED) 102, 104 and 106. Same-elevation LED 102, being the one of greatest concern, may be for example, a red LED. The other two LEDs 104 and 106 are preferably non-red LED such as, for example white for LED 104 and green for LED 106. As disclosed in my prior issued patents, besides optical alerting, the outputs of elevation angle system 26' may energize acoustic, binaural acoustic, or combinations of these alerting devices.

Referring back to FIG. 4, in the light of the description overlapping beams 14*a* and 14*b*, it will be recalled that disclosure was made of sinusoidally sweeping the phase of one of the signals in phase adjuster 52, and determining the elevation of a target by detecting the maximum amplitude of the output of phase detector 56. In essence, this operation sweeps the ±7 degree detection region dynamically upward and downward by as much as 7 degrees from deck level. Although this dynamic sweeping embodiment is capable of more precise elevation angle determination, it accomplishes this at the expense of increased complexity. The embodiment of the invention in FIGS. 11 and 12 is relatively inexpensive because commercially available phase detectors, and the remaining electronic components are relatively low cost. Both embodiments are considered part of the present invention.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An antenna comprising:

a first quarter-wave whip pointing in a first direction;

a second quarter-wave whip pointing in a second direction opposite to said first direction;

axes of said first and second quarter-wave whips being substantially collinear;

a base of said first quarter-wave whip being spaced along said axis from a base of said second quarter-wave whip a distance effective to establish a desired relationship between phases of signals received on said first and second quarter-wave whips;

said first quarter-wave whip includes a first quarter-wave stub collinear therewith and pointing in said second direction;

said second quarter-wave whip includes a second quarter-wave stub collinear therewith and pointing in said first direction;

at least one of said first and second quarter-wave stubs including a dielectric; and said dielectric having a velocity factor to adjust an electrical quarter wavelength at a desired operating frequency to a physical dimension substantially equal to said distance.

2. An antenna according to claim 1 wherein:

said first and second quarter-wave stubs are first and second coaxial lines disposed end to end with each other; and said dielectric is a plastic resin.

3. An antenna according to claim 1, wherein:

said distance is about ⅜ electrical wavelength at a desired operating frequency; and said distance is about ½ physical wavelength at said desired operating frequency.

4. An elevation angle detection system comprising:

a first antenna disposed in a first direction;

a second antenna disposed in a second direction opposite said first direction;

a phase inverter attached to said second antenna;

said phase inverter producing a phase delay substantially equal to 180 electrical degrees at on operating frequency to produce a phase-delayed signal;

a phase detector receiving a signal from said first antenna and said phase-delayed signal; and an output of said phase detector indicating the presence of an emitting source within a predetermined angle of a normal plane to said first and second directions.

5. An elevation angle detection system according to claim 4, wherein:

a base of said first antenna being spaced from a base of said second antenna by a distance effective to establish said predetermined angle.

6. An elevation angle detection system according to claim 5, wherein said distance is about ⅜ physical wavelength.

7. An elevation angle detection system according to claim 6, wherein said distance is about ½ electrical wavelength.

8. An alerting system comprising:

a first antenna disposed in a first direction;

a second antenna disposed in a second direction opposite said first direction;

a phase inverter attached to said second antenna;

said phase inverter producing a phase delay substantially equal to 180 electrical degrees at on operating frequency to produce a phase-delayed signal;

a phase detector receiving a signal from said first antenna and said phase-delayed signal;

an output of said phase detector indicating the presence of an emitting source within a predetermined angle of a normal plane to said first and second directions;

a bearing angle detection device for detecting a bearing angle of said emitting source; and a suppression device effective for suppressing output of said bearing angle detection device when said emitting source is outside said predetermined angle, and for enabling said output of said bearing angle detection device when said emitting source is within said predetermined angle.

9. An alerting system according to claim 8, further comprising:

a range detection device effective for producing an in-range signal when said emitting source is within a predetermined range; and said suppression device being responsive to said in-range signal for enabling said output of said bearing angle detection device only in the presence of said in-range signal.

10. An alerting system comprising:

a first antenna disposed in a first direction;

a second antenna disposed in a second direction opposite said first direction;

a phase inverter attached to said second antenna;

said phase inverter producing an inverted signal substantially inverted by about 180 electrical degrees at on operating frequency to produce a phase-inverted signal;

a first phase detector receiving a signal from said first antenna;

a first phase delay effective to phase delay said phase-inverted signal to produce a phase-delayed phase-inverted signal;

said phase-delayed phase-inverted signal being applied to a second input of said first phase detector;

a second phase detector receiving said phase-inverted signal at a first input;

a second phase delay effective to phase delay said signal from said first antenna to produce a second phase-delayed signal;

said second phase-delayed signal being applied to a second input of said second phase detector;

a first AND gate responsive to a simultaneous output of said first and second phase detectors for producing a first output;

a second AND gate responsive to a simultaneous output of said first phase detector and an absence of an output of said first AND gate for producing a second output; and a third AND gate responsive to a simultaneous output of said second phase detector and an absence of an output of said first AND gate for producing a third output.

* * * * *